US007983395B2

(12) United States Patent
Saito

(10) Patent No.: US 7,983,395 B2
(45) Date of Patent: Jul. 19, 2011

(54) ROTATION ANODE X-RAY TUBE

(75) Inventor: Shin Saito, Otawara (JP)

(73) Assignees: Kabushiki Kaisha Toshiba, Tokyo (JP); Toshiba Electron Tubes & Devices Co., Ltd., Tochigi-Ken (JP)

( * ) Notice: Subject to any disclaimer, the term of this patent is extended or adjusted under 35 U.S.C. 154(b) by 0 days.

(21) Appl. No.: 11/603,209

(22) Filed: Nov. 22, 2006

(65) Prior Publication Data

US 2007/0140433 A1 Jun. 21, 2007

(30) Foreign Application Priority Data

Nov. 25, 2005 (JP) ..... 2005-340720

(51) Int. Cl.
*H01J 5/18* (2006.01)

(52) U.S. Cl. ..... 378/140; 378/141

(58) Field of Classification Search ..... 378/140, 378/141
See application file for complete search history.

(56) References Cited

U.S. PATENT DOCUMENTS

| | | | | |
|---|---|---|---|---|
| 6,301,332 | B1 | 10/2001 | Rogers et al. | |
| 6,478,902 | B2 * | 11/2002 | Koenigsmann et al. | 148/681 |
| 2005/0123713 | A1 * | 6/2005 | Forrest et al. | 428/66.6 |
| 2006/0016528 | A1 * | 1/2006 | Hatakeyama | 148/684 |
| 2006/0269048 | A1 * | 11/2006 | Cain | 378/142 |

FOREIGN PATENT DOCUMENTS

| | | |
|---|---|---|
| DE | 1 079 330 | 4/1960 |
| DE | 101 28 245 | 6/2002 |
| GB | 1163481 | 9/1969 |
| JP | 04-188551 | 7/1992 |
| JP | 06-251736 | 9/1994 |
| JP | 11-510955 | 9/1999 |
| JP | 2000-200695 | 7/2000 |
| JP | 2002-352756 A | 12/2002 |
| JP | 2003-142016 | 5/2003 |
| WO | WO 2005/038854 | 4/2005 |

OTHER PUBLICATIONS

European Search Report dated Apr. 26, 2007 for Appln. No. 06124633.6-2208.
Japanese Office Action dated Nov. 9, 2010.

* cited by examiner

*Primary Examiner* — Hoon Song
*Assistant Examiner* — Mona M Sanei
(74) *Attorney, Agent, or Firm* — Pillsbury Winthrop Shaw Pittman, LLP

(57) ABSTRACT

There are provided an anode target which generates X-rays due to electrons e being incident, an emitter source which emits electrons e to be incident into the anode target, a ring-shaped recoil electron capturing structure which surrounds an orbit of electrons e heading from the emitter source toward the anode target, and captures electrons e emitted from the emitter source and recoiled on the anode target, and a vacuum envelop which keeps at least a periphery of the anode target, the emitter source, and the recoil electron capturing structure at a predetermined degree of vacuum, and the recoil electron capturing structure has a first member formed from strengthened copper which is exposed to the inside of the recoil electron capturing structure, and a second member formed from copper which is disposed at the outside in the radial direction of the first member.

11 Claims, 3 Drawing Sheets

ROTATION ANODE X-RAY TUBE

CROSS-REFERENCE TO RELATED APPLICATIONS

This application is based upon and claims the benefit of priority from prior Japanese Patent Application No. 2005-340720, filed Nov. 25, 2005, the entire contents of which are incorporated herein by reference.

BACKGROUND OF THE INVENTION

1. Field of the Invention

The present invention relates to a rotation anode X-ray tube which is mounted on an X-ray image diagnostic system, a nondestructive inspection system, or the like.

2. Description of the Related Art

A rotation anode X-ray tube which is mounted on an X-ray image diagnostic device, a nondestructive inspection system, or the like, and which is used as a source of release of X-rays has been known. This rotation anode X-ray tube has an anode target which generates X-rays by electron collision, an electron emitting source which emits electrons toward the anode target, and a vacuum envelope which keeps at least the periphery of the anode target and the electron emitting source at a predetermined degree of vacuum.

The electrons emitted from the electron emitting source are accelerated by a voltage applied between the anode target and the electron emitting source, and are made to collide against a focal plane of the anode target. The electrons which have collided against the anode target are converted into heat and X-rays on the anode target, and some of generated X-rays are outputted from an X-ray transmission window provided at the vacuum envelope.

However, among the electrons which have collided against the anode target, there are some electrons which have not been converted into heat or X-rays, but become recoil electrons to repeatedly scatter about. A direction and intensity of recoil electrons are changed in accordance with an applied voltage or an electric field in the vicinity of a focal point. However, usually, 40% or more of incident electrons recoil in all directions.

Recoil electrons return to portions other than the focal plane of the anode target, or rush into the vacuum envelop. Heat and X-rays are generated due to the recoil electrons returning or rushing-in.

X-rays generated by recoil electrons become a noise component with respect to X-rays generated from the focal plane of the anode target, which is impeditive for obtaining uniform X-rays. Further, heat generated by recoil electrons causes a rise in temperature of the anode target or the like.

Then, in order to solve these problems, there has been proposed a rotation anode X-ray tube in which recoil electrons returning to an anode target and recoil electrons rushing into a vacuum envelop are reduced by capturing generated recoil electrons. This rotation anode X-ray tube has a recoil electron capturing structure functioning as a trap for capturing recoil electrons between the anode target and the electron emitting source.

FIG. 6 is a partially cutaway perspective view showing a recoil electron capturing structure 100 in a conventional art. As shown in FIG. 6, the recoil electron capturing structure 100 is formed in a cylindrical shape so as to surround an orbit of electrons e heading from the electron emitting source toward the anode target, and captures recoil electrons re which have recoiled on the anode target by utilizing the inner peripheral surface thereof. In addition, a flow channel 101 for allowing coolant to flow is formed along the circumferential direction inside the peripheral wall of the recoil electron capturing structure 100, and heat generated by capturing recoil electrons is let out to the outside by the coolant flowing in the flow channel 101 (for example, in Jpn. Pat. Appln. KOKAI Publication No. 2002-352756 (on the third to fifth pages, FIG. 1).

Generally, electrons having extremely high energy are thrown into the anode target. Therefore, heat generation of the recoil electron capturing structure is made enormous, which requires intensive cooling. In accordance therewith, a great temperature gradient is brought about between a heating unit and a cooling unit of the recoil electron capturing structure, and as a result, a great thermal stress is generated at the junction between the recoil electron capturing structure and the vacuum envelop.

Generally, in many cases, the recoil electron capturing structure is structured based on a copper material having high thermal conductivity in order to let enormous amount of generated heat out to the outside as soon as possible. In particular, pure copper is excellent at thermal conductivity and brazing flowability, and is relatively inexpensive, and therefore, it is used in many cases.

However, pure copper easily brings about secondary recrystallization which is called surface roughness by repeating thermal stress as described above. When secondary recrystallization proceeds, generation of gas from crystalline boundaries, reduction in surface roughness, and the like are brought about by boundary sliding or the like, which results in deterioration in withstand voltage. Namely, there is a defect that the life span is short in a recoil electron capturing structure formed from pure copper as a material.

Then, in recent years, in order to improve the short life span of pure copper, oxide-dispersion-strengthened copper whose mechanical strength is enhanced by dispersing oxide in pure copper has been used. One example thereof is alumina (aluminum oxide) dispersed copper and the like. Further, strengthened copper alloy whose mechanical strength has been enhanced by making a copper alloy by mixing a slight amount of dissimilar metal into pure copper has also been used. One example thereof is copper alloy such as chrome, tungsten, and the like.

Both of oxide-dispersion-strengthened copper and strengthened copper alloy are used for the purpose of enhancing the mechanical strength while keeping the high thermal conductivity of copper to some extent, and the defect in pure copper described above can be improved to some extent by using those as materials.

However, because oxide-dispersion-strengthened copper and strengthened copper alloy have ductility lower than that of pure copper, when crystal breaking is once brought about, the breaking becomes cracks, which rapidly proceed and finally lead to atmospheric penetration in some cases. Namely, there is a defect that it is impossible to keep vacuum tight at the inside of the vacuum envelop in a recoil electron capturing structure formed from oxide-dispersion-strengthened copper or strengthened copper alloy as a material.

Next, proceeding of cracks and the effect thereof in a recoil electron capturing structure formed from alumina-dispersed copper as a material will be described in detail with reference to FIGS. 7 and 8.

FIG. 7 is a plan view of a recoil electron capturing structure by using alumina-dispersed copper as a material in the conventional art, and FIG. 8 is a cross-sectional view of the recoil electron capturing structure by using alumina-dispersed copper as a material in the conventional art.

Cracks C generated on the inner peripheral surface of the recoil electron capturing structure 100 proceed along radial directions of the recoil electron capturing structure 100, and penetrate up to the flow channel 101 formed inside the recoil electron capturing structure 100 as shown in FIGS. 7 and 8. Note that, because the flow channel 101 is connected to a cooler installed at the outside of the vacuum envelop, the fact that the cracks C penetrate up to the flow channel 101 means that the cracks C bring about atmospheric penetration.

In particular, with respect to oxide-dispersion-strengthened copper such as alumina-dispersed copper and the like, a drawing process or an extrusion process is used as a method for manufacturing the material. Therefore, in many cases, a specific crystal orientation is brought about in the material in consequence of the drawing process or the extrusion process. Further, there is a trend that a great force to be enlarged radially by heating is applied to the recoil electron capturing structure. Accordingly, when a crystal orientation of the oxide-dispersion-strengthened copper and an axial direction of the recoil electron capturing structure are matched with each other, a force is applied to the recoil electron capturing structure so as to pull away crystal fibers from each other, which makes generated cracks easily progress in radial directions of the recoil electron capturing structure 100.

Moreover, when a recoil electron capturing structure formed from an oxide-dispersed copper, a strengthened copper alloy, or the like as a material is used for a rotation anode X-ray tube, as long as generated cracks are small, withstand voltage is hardly affected. Therefore, in some cases, the rotation anode X-ray tube is made unusable at a point in time when atmospheric penetration is brought about finally due to cracks proceeding insidiously. Namely, there is a possibility that the rotation anode X-ray tube becomes suddenly unusable, which is unfavorable for medical use.

Further, in many cases, the recoil electron capturing structure is joined with a vacuum envelop 102 by brazing with copper serving as a brazing filler metal. However, when an oxide-dispersed copper, a strengthened copper alloy, or the like is used as a material of the recoil electron capturing structure, there is a defect that the brazing flowability with respect to the recoil electron capturing structure is deteriorated, and stress peeling and the like are easily brought about at the junction between the recoil electron capturing structure and the vacuum envelop 102.

To summarize the description, because an enormous amount of heat is generated in a recoil electron capturing structure, a copper material having high thermal conductivity, and a structure of internal forced liquid-cooling are used. However, when pure copper is used as a material for a recoil electron capturing structure, gas emission due to surface roughness and short life span due to deterioration in withstand voltage are brought about by repeating thermal stress during use. On the other hand, because cracks easily proceed in oxide-dispersion-strengthened copper and strengthened copper alloy which are used for elongating life span as long as possible, when an oxide-dispersion-strengthened copper or a strengthened copper alloy is used as a material for a recoil electron capturing structure, there is the risk that penetration-leakage defect is suddenly brought about.

BRIEF SUMMARY OF THE INVENTION

The present invention has been achieved in consideration of the above-described circumstances, and an object thereof is to provide a highly reliable rotation anode X-ray tube having a long life span.

In order to solve the above-described problems, and to achieve the object of the present invention, the rotation anode X-ray tube in the present invention is structured as follows.

A rotation anode electron tube comprises: an anode target which generates X-rays due to electrons being incident; an electron emitting source which emits electrons to be incident into the anode target; a recoil electron capturing structure having: a first member which surrounds an orbit of the electrons heading from the electron emitting source toward the anode target, and captures electrons emitted from the electron emitting source and recoiled on the anode target, and which is in a ring shape and is formed from strengthened copper exposed to an inside; and a second member formed from copper, which is disposed at an outside in a radial direction of the first member; and a vacuum envelop which keeps at least a periphery of the anode target, the electron emitting source, and the recoil electron capturing structure at a predetermined degree of vacuum.

A rotation anode X-ray tube comprises: an anode target which generates X-rays due to electrons being incident; an electron emitting source which emits electrons to be incident into the anode target; a recoil electron capturing structure which surrounds an orbit of the electrons heading from the electron emitting source toward the anode target, and captures electrons emitted from the electron emitting source and recoiled on the anode target, and which is in a ring shape and formed from a material having a specific crystal orientation intersecting with an axial direction thereof; and a vacuum envelop which keeps at least a periphery of the anode target, the electron emitting source, and the recoil electron capturing structure at a predetermined degree of vacuum.

In accordance with the present invention, life span of the rotation anode X-ray tube is elongated, and the reliability thereof is improved.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, a first embodiment and a second embodiment will be described with reference to the drawings. First, the first embodiment will be described in detail with reference to FIGS. 1 and 2.

[Structure of Rotation Anode X-ray Tube]

Figure 1:
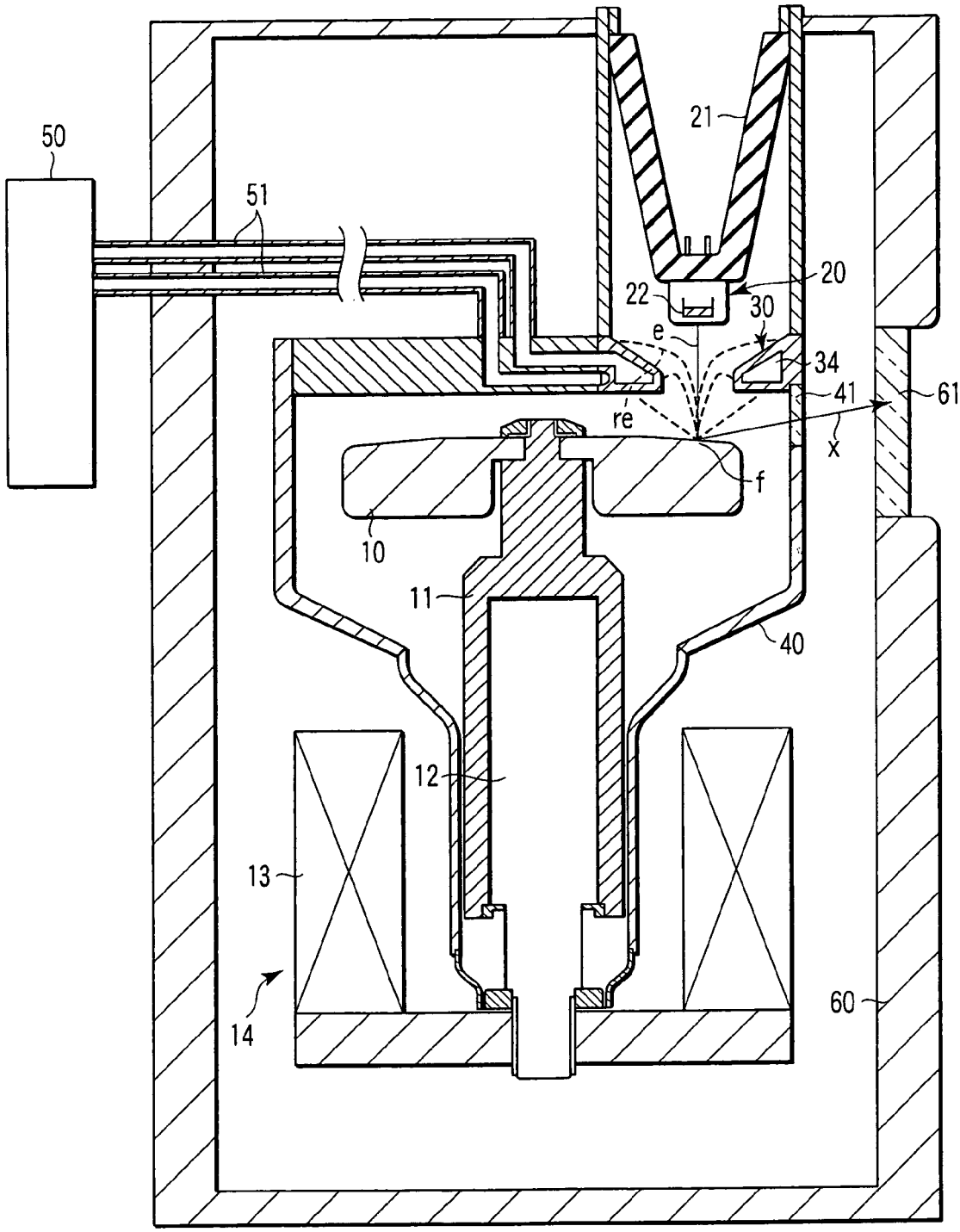
FIG. 1 is a cross-sectional view of a rotation anode X-ray tube in a first embodiment of the present invention.

FIG. 1 is a cross-sectional view of a rotation anode X-ray tube in the first embodiment of the present invention. As shown in FIG. 1, the rotation anode X-ray tube in the present embodiment is mounted on an X-ray image diagnostic system, a nondestructive inspection system, or the like, and is housed in a housing 60 filled with coolant. As a coolant, a non-grease-based coolant having low electric conductivity which consists primarily of water, a well-known insulating oil, or the like is used.

The rotation anode X-ray tube has: an anode target 10 which radiates X-rays x by collision of electrons e; a cathode assembly body 20 which is disposed so as to face the anode target 10, and emits electrons e toward the anode target 10; a recoil electron capturing structure 30 which is disposed between the anode target 10 and the cathode assembly body 20, and captures recoil electrons re recoiling on the anode target 10; and a vacuum envelop 40 in which the anode target 10, the cathode assembly body 20, and the recoil electron capturing structure 30 are housed, and which keeps the periphery of these components at a predetermined degree of vacuum.

The anode target 10 is formed to be disk-like, and the central portion thereof in the radial direction is supported by a rotator 11. The rotator 11 is supported so as to be rotatable by a fixed shaft 12, and structures a motor 14 for rotating the anode target 10 along with a stator coil 13 installed outside the vacuum envelop 40. When the anode target 10 is being rotated, electrons e from the cathode assembly body 20 are not irradiated intensively on one area of the anode target 10 even if the rotation anode X-ray tube is used for a long time, and therefore, the anode target 10 is not overheated.

The cathode assembly body 20 is attached to the vacuum envelop 40 via an insulating member 21 in order to be electrically insulated from the vacuum envelop 40, and an emitter source (electron emitting source) 22 for emitting electrons e is disposed at a place corresponding to the anode target 10. As a material of the insulating member 21, for example, alumina ceramics or the like is used.

Figure 2:
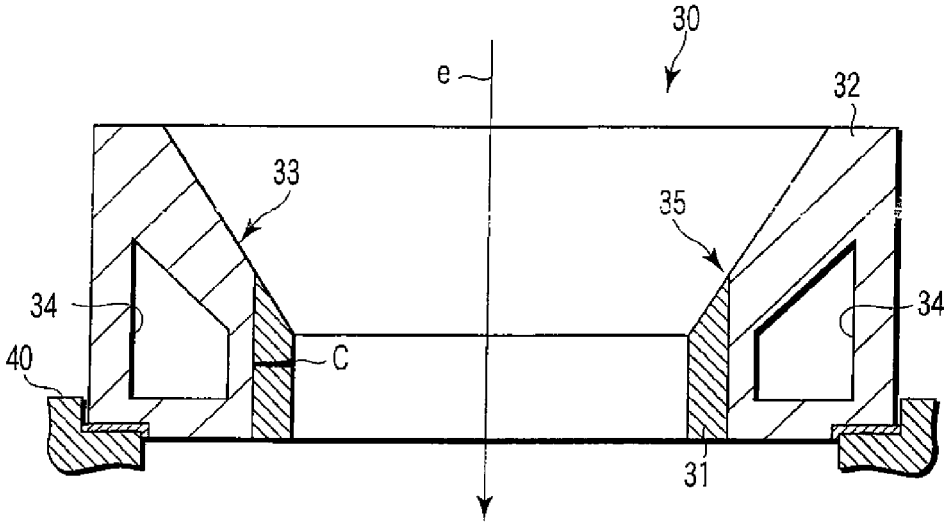
FIG. 2 is a cross-sectional view of a recoil electron capturing structure in the embodiment.

FIG. 2 is a cross-sectional view of the recoil electron capturing structure 30 in the embodiment. As shown in FIG. 2, the recoil electron capturing structure 30 is in a ring shape so as to surround an orbit of electrons e heading from the emitter source 22 of the cathode assembly body 20 toward the anode target 10, and is structured from a ring-shaped first member 31 disposed at the inside in the radial direction of the recoil electron capturing structure 30, and a ring-shaped second member 32 disposed at the outside in the radial direction of the recoil electron capturing structure 30.

As a material of the first member 31, alumina-dispersed copper (oxide-dispersion-strengthened copper) which is a material having high thermal conductivity and hardly bringing about secondary recrystallization, or a copper alloy (strengthened copper alloy) such as chrome, tungsten, or the like is used. As a material of the second member 32, pure copper or the like which is a material which has high thermal conductivity, and in which cracks C hardly proceed is used.

The first member 31 and the second member 32 are joined together by diffusion joining, and a tapered plane 33 whose inside diameter is enlarged as being separated from the anode target 10 is formed on the inner peripheral portion of an end portion facing the cathode assembly body 20. The tapered plane 33 is structured from an end face of the first member 31 and an end face of the second member 32, and there is scarcely any step on a boundary portion between the first member 31 and the second member 32.

The second member 32 is joined with the vacuum envelop 40 by brazing, and a ring-shaped flow channel 34 for allowing coolant to flow is formed inside thereof. Note that pure copper is used as a brazing filler metal.

The entire flow channel 34 except the inlet and the outlet for coolant is positioned inside the second member 32, and does not interfere with a joint surface 35 between the first member 31 and the second member 32 at all. Further, the flow channel 34 is connected through a piping 51 to a cooler 50 disposed outside the housing 60. Accordingly, the inside of the flow channel 34 is regarded as the outside of the vacuum envelop 40, i.e., the outside of vacuum. Namely, the joint surface 35 between the first member 31 and the second member 32 is not exposed to the outside of vacuum, but exists in vacuum.

[Operations of Rotation Anode X-ray Tube]

First, electrons e are emitted from the emitter source 22 of the cathode assembly body 20. The emitted electrons e are accelerated by a high voltage applied between the anode target 10 and the cathode assembly body 20, and are made to collide against a focal plane f of the anode target 10. The electrons e which have collided against the anode target 10 are converted into heat and X-rays x, and some of the generated X-rays x permeate through an X-ray transmission window 41, and are outputted from an X-ray output window 61 to the outside of the housing 60.

However, some of the electrons e which have collided against the focal plane f of the anode target 10 are not converted into heat or X-rays x, but become recoil electrons re to repeatedly scatter about. The recoil electrons re recoiling on the anode target 10 are captured by the recoil electron capturing structure 30.

When the recoil electrons re are incident into the recoil electron capturing structure 30, an enormous amount of heat is generated in the recoil electron capturing structure 30, in particular, in the first member 31 disposed at the inside radially. However, the enormous amount of heat generated in the first member 31 is propagated to the second member 32 to be discharged to the outside by the coolant circulating in the flow channel 34.

When the rotation anode X-ray tube is repeatedly used, small cracks C are generated on the surface of the first member 31 exposed to hard thermal stress by repeatedly heating and cooling the recoil electron capturing structure 30.

These cracks C proceed in radial directions of the recoil electron capturing structure 30 by further using the rotation anode X-ray tube. However, when the cracks C reach the second member 32, the proceeding of the cracks C is stopped by random crystallization of pure copper serving as a material of the second member 32. Namely, the cracks C generated in the first member 31 do not proceed beyond the joint surface 35 with the second member 32. In accordance therewith, the life span of the recoil electron capturing structure 30 is made dramatically longer than that of the recoil electron capturing structure 30 formed from only alumina-dispersed copper.

EFFECTS IN ACCORDANCE WITH THE PRESENT EMBODIMENT

In the present embodiment, the recoil electron capturing structure 30 is structured from the first member 31 disposed at the inside in the radial direction, and the second member 32 disposed at the outside in the radial direction. In addition, alumina-dispersed copper in which secondary recrystallization is hardly brought about is used as a material of the first member 31, and pure copper in which cracks C hardly proceed is used as a material of the second member 32.

Therefore, even if cracks C are generated in the first member 31 by repeatedly using the rotation anode X-ray tube, the proceeding of these cracks C are stopped at a point in time when the cracks C reach the second member 32. Therefore, the life span of this recoil electron capturing structure is made dramatically longer than that of a conventional recoil electron capturing structure formed from only alumina-dispersed copper. Further, because the second member 32 is covered with the first member 31, and is not exposed to recoil electrons re, the second member 32 does not bring about secondary recrystallization in any case, and as a result, deterioration in withstand voltage is suppressed as compared with the conventional recoil electron capturing structure. Moreover, because a material of the second member 32 is pure copper, the brazing flowability in brazing between the second member 32 and the vacuum envelop 40 is improved, and the reliability in joining between the recoil electron capturing structure 30 and the vacuum envelop 40 is also improved.

In the present embodiment, the first member 31 and the second member 32 are joined together by diffusion joining. Therefore, since there is no third material between the first member 31 and the second member 32, a flow of heat from the first member 31 to the second member 32 is not interrupted by the joint surface 35 between the first member 31 and the second member 32 in any case, and as a result, the cooling efficiency is dramatically improved as compared with the conventional recoil electron capturing structure 30. Moreover, because there is no third material between the first member 31 and the second member 32, a third material does not protrude on the tapered plane 33 from the joint surface 35 between the first member 31 and the second member 32 in the manufacturing process of the recoil electron capturing structure 30 in any case. Accordingly, because a process of eliminating the third material protruding from the tapered plane 33 of the recoil electron capturing structure 30 is not required, the surface of the tapered plane 33 is not roughened, and as a result, factors bringing about deterioration in withstand voltage of the recoil electron capturing structure 30 are reduced.

In the present embodiment, the joint surface 35 between the first member 31 and the second member 32 exists in vacuum of the vacuum envelop 40. In other words, the joint surface 35 between the first member 31 and the second member 32 does not interfere with the flow channel 34 formed in the second member 32. Moreover, to describe concretely, the cooling flow channel 34 is formed at a position shifted from the joint surface 35 between the first member 31 and the second member 32. Therefore, even if the first member 31 is considerably deteriorated, and many cracks C generated in the first member 31 reach the second member 32, a degree of vacuum in the vacuum envelop 40 is reliably kept.

Note that, in the present embodiment, an alumina-dispersed copper (oxide-dispersion-strengthened copper) or a copper alloy such as chrome, tungsten, or the like (strengthened copper alloy) is used as the first member 31. However, any material which has high thermal conductivity and in which secondary crystallization is hardly brought about can be used without being limited in particular.

SECOND EMBODIMENT

Figure 3:
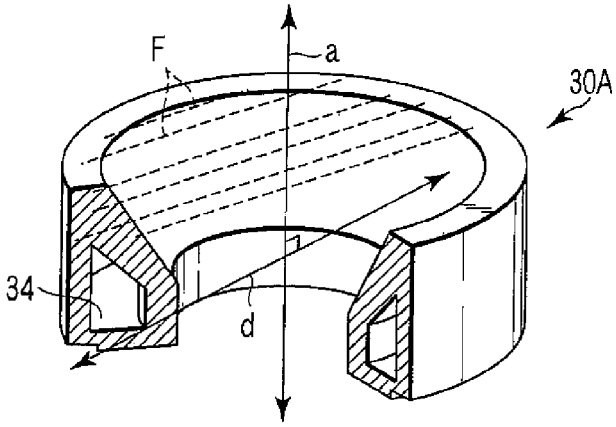
FIG. 3 is a partially cutaway perspective view of a recoil electron capturing structure in a second embodiment of the present invention.
Figure 4:
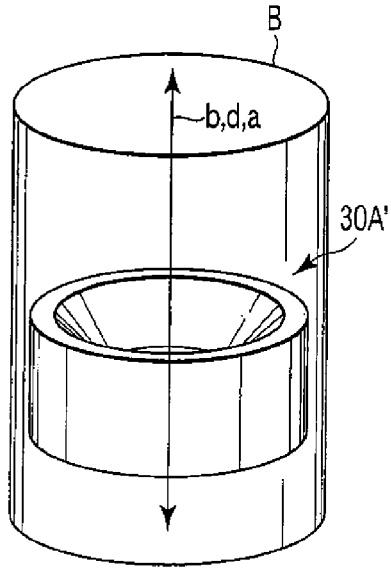
FIG. 4 PRIOR ART
FIG. 4 is an explanatory diagram for explanation of the recoil electron capturing structure in the embodiment.
Figure 5:
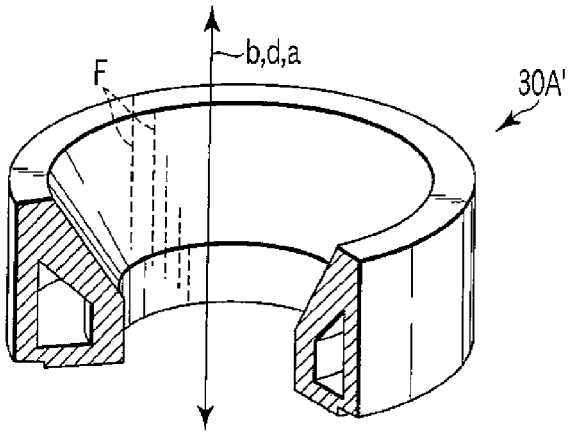
FIG. 5 PRIOR ART
FIG. 5 is an explanatory diagram for explanation of the recoil electron capturing structure in the embodiment.
Figure 6:
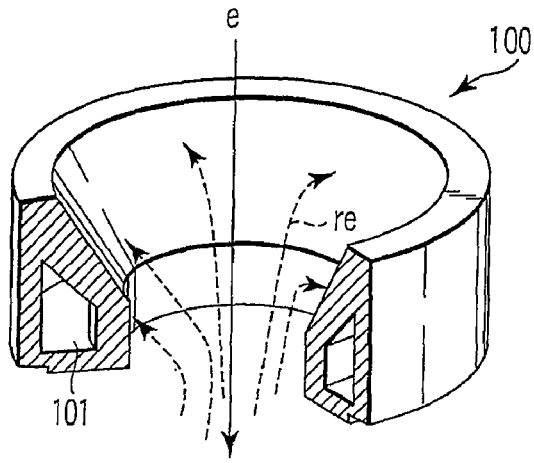
FIG. 6 Prior Art
FIG. 6 is a partially cutaway perspective view of a recoil electron capturing structure in a conventional art.
Figure 7:
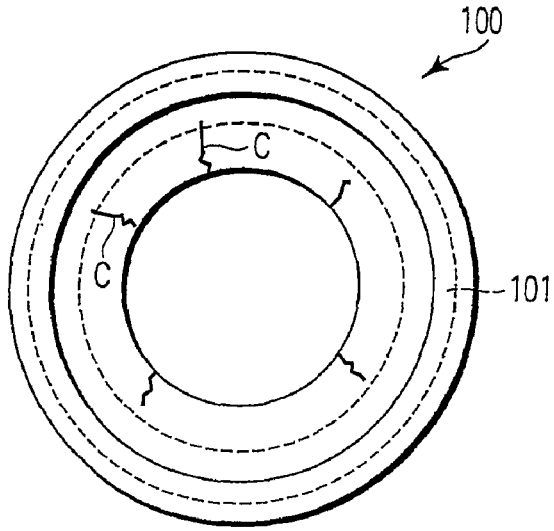
FIG. 7 Prior Art
FIG. 7 is a plan view of a recoil electron capturing structure formed from alumina-dispersed copper as a material in the conventional art.
Figure 8:
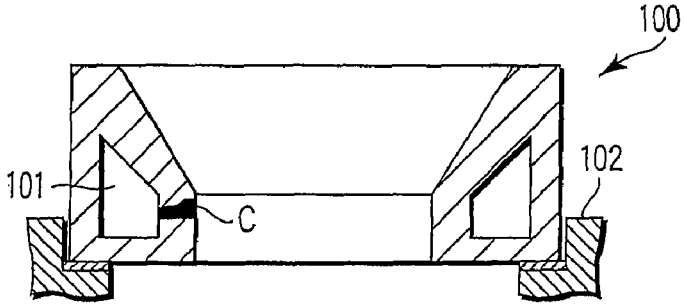
FIG. 8 Prior Art
FIG. 8 is a cross-sectional view of the recoil electron capturing structure formed from alumina-dispersed copper as a material in the conventional art.

Next, a second embodiment will be described in detail with reference to FIGS. 3 to 5. FIG. 3 is a partially cutaway perspective view of a recoil electron capturing structure 30A in the second embodiment of the present invention. As shown in FIG. 3, the recoil electron capturing structure 30A in the present embodiment has the same shape as that in the first embodiment, but is entirely made of alumina-dispersed copper.

Here, characteristics of a conventional recoil electron capturing structure 30A' will be described. FIG. 4 is an explanatory diagram for explanation of the recoil electron capturing structure 30A in the embodiment, and FIG. 5 is an explanatory diagram for explanation of the recoil electron capturing structure 30A in the embodiment. Note that reference code B in FIG. 4 denotes a bar material prepared by a drawing process or an extrusion process. Further, reference code F in FIG. 5 denotes crystal fibers of alumina-dispersed copper.

The conventional recoil electron capturing structure 30A' is manufactured by cutting a material of bar-shaped alumina-dispersed copper which is formed by a drawing process or an extrusion process into a plurality of portions. Therefore, as shown in FIG. 4, an axial direction a of the conventional recoil electron capturing structure 30A' accords with a direction b of a drawing process or an extrusion process. As a result, as shown in FIG. 5, the axial direction a and a crystal orientation d accord with one another.

However, in the recoil electron capturing structure 30 in the present embodiment, as shown in FIG. 3, the crystal orientation d of the alumina-dispersed copper intersects with the axial direction a of the recoil electron capturing structure 30A at a substantially right angle. Therefore, even if the recoil electron capturing structure 30 is enlarged radially by heating, a force for pulling away crystal fibers F from each other is not applied much to the recoil electron capturing structure 30. Accordingly, even if cracks C are generated in the recoil electron capturing structure 30A, the cracks C hardly proceed in radial directions of the recoil electron capturing structure 30. Namely, in the present embodiment, by shifting the crystal orientation d of the recoil electron capturing structure 30A from a direction in which cracks C easily proceed, the proceeding of the cracks C generated in the recoil electron capturing structure 30A is prevented.

In the present embodiment, when the recoil electron capturing structure 30A is manufactured, first, a plate material thicker than a length in the axial direction a of the recoil electron capturing structure 30A is prepared by a drawing process or an extrusion process. Then, the recoil electron capturing structure 30A is chipped away from the plate material such that the axial direction a of the recoil electron capturing structure 30A and the thickness direction of the plate material accord with one another. In this way, provided that a plate material thicker than a length in the axial direction a of the recoil electron capturing structure 30A is prepared, it is easy to prepare the recoil electron capturing structure 30A in the present embodiment.

Note that, in the present embodiment, the recoil electron capturing structure 30A is structured from one member. However, the structure is not limited thereto, and in the same way as in the first embodiment, the recoil electron capturing structure 30A may be structured from a ring-shaped first member positioned at the inside radially, and a ring-shaped second member positioned at the outside radially. In such a case, provided that alumina-dispersed copper is used as a material of the first member, and a crystal orientation d thereof is made to intersect with an axial direction a of the recoil electron capturing structure 30A at a substantially right angle, a life span of the recoil electron capturing structure 30A is further elongated by a synergistic effect with the first embodiment.

Further, in the present embodiment, the crystal orientation d of the alumina-dispersed copper intersects with the axial direction a of the recoil electron capturing structure 30A at a substantially right angle. However, the structure is not limited thereto, and it suffices that, for example, the crystal orientation d of the alumina-dispersed copper may be even slightly inclined with respect to the axial direction a of the recoil electron capturing structure 30A.

The present invention is not limited to the embodiments described above as it is, and at the stage of implementing the invention, the components of the present invention can be modified and embodied within a range which does not deviate from the spirit of the present invention. Further, various inventions can be formed by appropriately combining the plurality of components disclosed in the embodiments described above. For example, some components may be eliminated from all the components shown in the embodiments. Moreover, components relating to different embodiments may be appropriately combined.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A rotation anode electron tube comprising:

an anode target which generates X-rays due to electrons being incident;

an electron emitting source which emits electrons to be incident into the anode target;

a recoil electron capturing structure comprising:

a first member, which surrounds an orbit of the electrons heading from the electron emitting source toward the anode target and captures electrons emitted from the electron emitting source and recoiled on the anode target, the first member being in a ring shape, formed from an oxide-dispersion-strengthened copper having a crystal orientation throughout the first member that is parallel in one specified direction that is perpendicular to an axial direction of the recoil electron capturing structure, the first member being exposed on an inside surface thereof such that the crystal orientation substantially inhibits crack propagation from the inside surface in a radial direction of the first member; and a second member formed from pure copper having random crystallinity, the second member being positioned outside the first member along a radial direction; and a vacuum envelop which keeps at least a periphery of the anode target, the electron emitting source, and the recoil electron capturing structure at a predetermined degree of vacuum.

2. The rotation anode electron tube according to claim 1, wherein the first member and the second member are joined together by diffusion joining.

3. The rotation anode electron tube according to claim 1, wherein a flow channel through which coolant for cooling the recoil electron capturing structure flows, and a vacuum-tight sealing portion are formed at positions shifted from a joint surface between the first member and the second member in the recoil electron capturing structure.

4. The rotation anode electron tube according to claim 1, wherein the crystal orientation is slightly inclined with respect to the axial direction of the recoil electron capturing structure.

5. The rotation anode electron tube according to claim 1, wherein the crystal orientation specified in one direction is produced by a drawing or an extrusion process.

6. A rotation anode X-ray tube comprising:

an anode target which generates X-rays due to electrons being incident;

an electron emitting source which emits electrons to be incident into the anode target;

a recoil electron capturing structure which surrounds an orbit of the electrons heading from the electron emitting source toward the anode target and captures electrons emitted from the electron emitting source and recoiled on the anode target, the recoil electron capturing structure being in a ring shape and formed of an oxide-dispersion-strengthened copper having a crystal orientation throughout the recoil electron capturing structure that is parallel in one specified direction that is perpendicular to an axial direction of the recoil electron capturing structure such that the crystal orientation substantially inhibits crack propagation from an inside surface of the recoil electron capturing structure in a radial direction thereof; and a vacuum envelop which keeps at least a periphery of the anode target, the electron emitting source, and the recoil electron capturing structure at a predetermined degree of vacuum.

7. The rotation anode electron tube according to claim 6, wherein the crystal orientation is slightly inclined with respect to the axial direction of the recoil electron capturing structure.

8. The rotation anode electron tube according to claim 6, wherein the crystal orientation specified in one direction is produced by a drawing or an extrusion process.

9. A rotation anode electron tube comprising:

an anode target which generates X-rays due to electrons being incident;

an electron emitting source which emits electrons to be incident into the anode target;

a recoil electron capturing structure comprising:

a first member which surrounds an orbit of the electrons heading from the electron emitting source toward the anode target and captures electrons emitted from the electron emitting source and recoiled on the anode target, the first member being in a ring shape and formed from an oxide-dispersion strengthened copper having a crystal orientation throughout the first member that is parallel in one specified direction that is perpendicular to an axial direction of the recoil electron capturing structure, the first member being disposed at an inside position at least in a radial direction such that the crystal orientation substantially inhibits crack propagation from an inner surface of the first member in a radial direction thereof; and a second member formed from copper, and disposed at an outside position in the radial direction of the first member, the second member sharing a joint surface with the first member, which is parallel to the axial direction;

a vacuum envelop which keeps at least a periphery of the anode target, the electron emitting source, and the recoil electron capturing structure at a predetermined degree of vacuum.

10. The rotation anode electron tube according to claim 9, wherein the crystal orientation is slightly inclined with respect to the axial direction of the recoil electron capturing structure.

11. The rotation anode electron tube according to claim 9, wherein the crystal orientation specified in one direction is produced by a drawing or an extrusion process.

* * * * *